US007527168B2

(12) United States Patent
Leichter et al.

(10) Patent No.: US 7,527,168 B2
(45) **Date of Patent: *May 5, 2009**

(54) CASSETTE FILM ROLL DISPENSER

(75) Inventors: Richard A. Leichter, 48 Grand Tour, Highlands, NJ (US) 07732; William S. Blake, Linwood, NJ (US)

(73) Assignee: Richard A. Leichter, Highlands, NJ (US)

( * ) Notice: Subject to any disclaimer, the term of this patent is extended or adjusted under 35 U.S.C. 154(b) by 209 days.

This patent is subject to a terminal disclaimer.

(21) Appl. No.: 11/285,872

(22) Filed: Nov. 23, 2005

(65) Prior Publication Data

US 2006/0180599 A1 Aug. 17, 2006

Related U.S. Application Data

(63) Continuation-in-part of application No. 10/696,763, filed on Oct. 29, 2003, now Pat. No. 7,040,503.

(51) Int. Cl.
*B65H 5/28* (2006.01)

(52) U.S. Cl. ..... 221/73; 221/25; 221/30; 221/71

(58) Field of Classification Search ..... 221/73, 221/71, 25, 30
See application file for complete search history.

(56) References Cited

U.S. PATENT DOCUMENTS

| | | | | |
|---|---|---|---|---|
| 4,676,861 | A * | 6/1987 | Bishop | 221/70 |
| 5,566,829 | A * | 10/1996 | Cotilletta | 221/25 |
| 5,938,070 | A * | 8/1999 | Welborn et al. | 221/73 |
| 6,439,289 | B1 * | 8/2002 | Schlotthauer | 221/71 |
| 6,755,321 | B2 * | 6/2004 | Solovay et al. | 221/73 |
| 7,040,503 | B2 * | 5/2006 | Leichter et al. | 221/73 |

* cited by examiner

*Primary Examiner*—Gene Crawford
*Assistant Examiner*—Timothy R Waggoner
(74) *Attorney, Agent, or Firm*—Robert M. Skolnik

(57) ABSTRACT

A manually operated dispenser for medicated or non-medicated orally dissolving strips provided in roll form cuts portions of the roll to a predetermined size in the manner of the strips currently available in single sheets and housed in the vial shown in patent Des. 423,302. The roll of orally dissolving strips is stored in one portion of a disposable cassette. Manually operable spring loaded means causes the roll in the cassette to advance thereby peeling the medicated or non-medicated portion of the strip form a carrier layer and presenting the portion of predetermined strip length to a cutting blade, then slicing the strip from the roll. The waste carrier layer is stored in another portion of the disposable cassette.

7 Claims, 2 Drawing Sheets

CASSETTE FILM ROLL DISPENSER

CROSS REFERENCE TO RELATED APPLICATIONS

This application is a continuation in part of our application Ser. No. 10/696,763, filed Oct. 29, 2003 now U.S. Pat. No. 7,040,503.

BACKGROUND OF THE INVENTION

1. Field of the Invention

The present invention relates to a cassette type manually operated dispenser for medicated or non-medicated orally dissolving strips provided in roll form. The dispenser cuts portions of the roll to a predetermined size in the manner of the strips currently available in single sheets and housed in the vial shown in patent Des. 423,302. The roll of orally dissolving strips is stored on in a cassette. Manually operable spring loaded means causes the roll in the cassette to advance thereby presenting material of a predetermined strip length to a cutting blade, then slicing the strip from the roll.

2. Description of the Related Art

Haner, et al. Des. 423,302 is the vial housing the strips currently on the market.

Wise, Re. 22,827, is one of many patents showing a stripping finger used to contact a rotatable cylinder to remove paper from the cylinder.

Carriero, U.S. Pat. No. 3,598,395, automatically feeds cards from a stack of cards by the use of detents 12-15.

Van Der Does, U.S. Pat. No. 3,627,307, dispenses film from a stack one sheet at a time by clipping the top sheet of the stack after the top sheet is raised by pinching the stack.

Stephens, et al, U.S. Pat. No. 4,269,403 show a feed roller with a plurality of fingers thereon. Pressure by the fingers on the stack is variable.

Haber, U.S. Pat. No. 5,119,969, discloses a pill strip dispenser where the package is advanced by toothed wheels.

Cotilletta, U.S. Pat. No. 5,566,829, presents sequentially cosmetic samples stored on a perforated tape.

Wade, et al., U.S. Pat. No. 5,881,350, represents a number of structures using two feed rollers one on the top and the other on the bottom of a stack.

Simpson, U.S. Pat. No. 6,550,636 dispenses single sheet from a spring-loaded structure having no moving parts.

Solovay, et al., U.S. Pat. No. 6,755,321, show a dispenser for adhesive backed articles.

SUMMARY OF THE INVENTION

This invention relates to a dispenser for the orally dissolving strips currently marketed under the trademark POCKETPAKS, for example. The strips, which may be medicated or non-medicated, are currently packaged and sold in a vial shown in DES. 423,302. The strips rapidly dissolve in the mouth thereby acting as an oral delivery system for drugs, breath freshener, etc. The present invention and the invention of our prior co-pending use a roll of such strip material and cuts portions of the roll to a desired length. The invention of our prior co-pending application required excessive user handling of the roll in order to place it in its operable position. The present invention first secures the roll in a cassette thereby avoiding the need to handle the roll. The present invention maintains a higher level of cleanliness than the structure shown in our prior co-pending application.

The roll is formed of the strip material plus a base layer serving as a carrier and as a separator. Unlike the invention of the prior co-pending application, the base layer/separator does not require use of an apertured edge engaging the advancing mechanism for delivering a portion of the strip material to a separating and cutting location. The base layer of the present invention has no apertures therein. In both the prior application and the present invention, the base layer serves to minimize the adverse effects of temperature and humidity on the strip material by preventing portions of the strip material from contacting other portions of the strip material. For example, the aforesaid POCKETPAKS vial is marked for storage between 59° F.-77° F. and to avoid humidity. Temperature and humidity cause the strip material to become too brittle or too soft or permits portions of the strip material to stick together.

A principal object of the invention is to provide a dispenser for a roll of medicinal strip material. Another object of the invention is the provision of a dispenser, which separates the medicinal material from a carrier/separator and then cut the medicinal material to a desired length. A further object is the provision of dispenser of the class described which minimizes the need to handle the strip material to maintain cleanliness. A further object of the invention is the provision of cassette storage of the medicinal material where the cassette has two storage compartments; one for the material, and the other where the waste base layer/separator is stored after the medicinal strip is peeled therefrom.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENT

Figure 1:
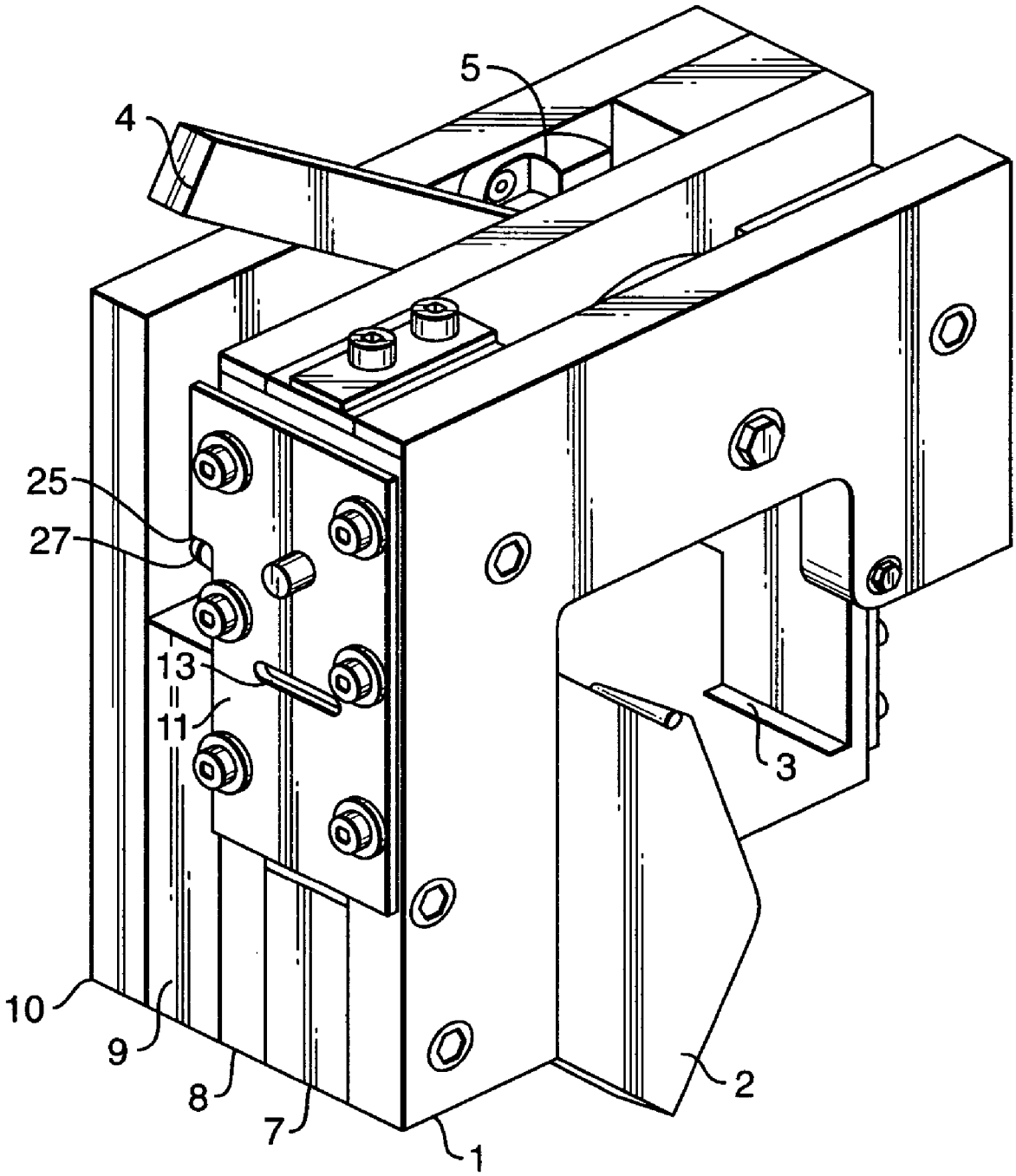
FIG. 1 is a perspective view of the assembly of the preferred embodiment of our invention.

| Reference Numeral | Part |
|---|---|
| 1 | plate |
| 2 | cassette cover |
| 3 | swing latch |
| 4 | actuating lever |
| 5 | cam surface |
| 6 | pawl spring |
| 7 | cassette support block |
| 8 | main housing block |
| 9 | spring mounting block |
| 10 | plate |
| 11 | moving blade |
| 12 | stationary blade |
| 13 | cutting aperture |
| 14 | cutting aperture |
| 15 | strip driver wheel |
| 16 | cassette housing |
| 17 | support block |
| 18 | support block |
| 19 | bow spring |
| 20 | transfer linkage |
| 21 | actuator spring |
| 22 | housing for roll product |
| 23 | take up housing for waste |
| 24 | boot seal |

-continued

| Reference Numeral | Part |
|---|---|
| 25 | ledge on blade |
| 26 | movable pawl |
| 27 | end portion of linkage |
| 28 | swing latch spring |

Figure 2:
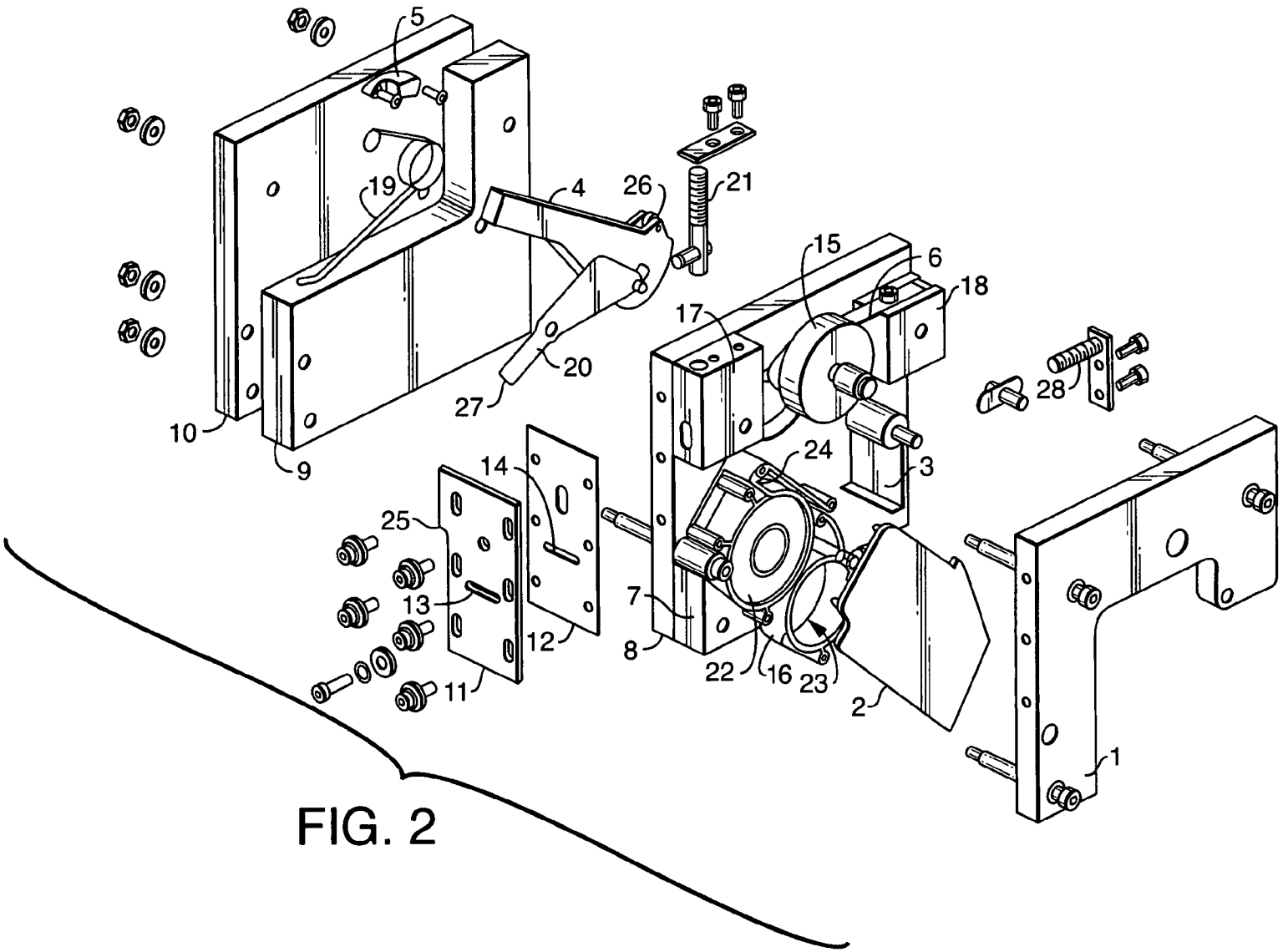
FIG. 2 is an exploded view of the preferred embodiment of our invention shown in FIG. 1.

Like reference numerals have been used to designate like parts in FIGS. 1-2. FIG. 1 is a perspective view of the cassette type dispenser of our invention. FIG. 2 is an exploded view of the dispenser of FIG. 1. A roll of medicinal strip material mounted on a carrier/separator is stored in housing 22 of cassette housing 16. A portion of this strip is peeled off the carrier/separator and the carrier separator free of the strip is connected beneath strip driver wheel 15. Rotation of wheel 15 counterclockwise, causes the medical strip to advance from the housing 22 for separation from the base layer and cutting. The waste strip is then stored in cassette housing portion 23.

The cassette is lifted into position beneath the driver wheel 15. The cassette is held in place by pivoting swing latch 3. Spring 28 applies force to swing latch 3. The latch is pivoted into and out of the cassette holding position to permit the cassette to be removed and a new cassette inserted. The cassette may be pre-wound with a leader portion of carrier material disposed to engage the driver wheel 15. In this manner, depression of the actuating lever against the spring force exerted by bow spring 19 causes the roll to advance within the cassette.

The driver wheel 15 is advanced by actuating lever 4. Transfer linkage 20 causes moveable cutting blade 11 to move upwardly relative to stationary blade 12. The end 27 of transfer linkage 20 is connected to the ledge 25 in blade 11 to move the blade up and down.

The film material is separated at the mouth of the cassette 2 in the manner shown and described in out aforementioned co-pending application. Boot seal 24 is provided in proximity to the mouth of the cassette to seal the cassette against humidity. The boot seal 24 also applies a low level of tension-tautness to the roll material to optimize operation.

Pawl spring 6 rides on the top of the wheel 15 to control the rotational force applied by the wheel to the roll material.

A curved cam surface 5 is provided for cooperation with portion 26 of actuating lever 4. More particularly, portion 26 rides on a series of serrations or latches (not shown) on cam surface 5 when the lever 4 is depressed. When fully depressed, portion 26 acts as a tooth and is held in place by the last of the latches or serrations on cam surface 5 and is released from that position by the force of compression spring 21 on transfer linkage 20.

As will now be seen, medicinal film material in a roll package with a separator layer beneath the film is stored in a cassette. The cassette is pre-packaged with a leader portion of separator layer extending outwardly from the cassette and positioned beneath the film advancing mechanism. The cassette is pivoted into place and held in position by a pivoting latch. Depression of a lever causes the leader to advance thereby drawing a predetermined length of medicinal film and separator layer through the peeler where the film is peeled from the separator and presented to a cutting blade. A further lever is attached to the first named lever to move the cutting blade up and down so that the predetermined length of medicinal film is cut from the roll.

The separator layer is fed to a take up compartment in the cassette for disposal.

Further modifications to the apparatus of the invention may be made without departing from the spirit and scope of the invention; accordingly, what is sought to be protected is set forth in the appended claims.

What is claimed is:

1. A dispenser for a roll of a film of orally dissolving material peelably affixed to a support surface; a cassette for housing said roll, said cassette having a supply portion for storing said roll and a take up portion for storing said support surface after it is peeled from said film; peeling means formed in said cassette for peelably removing said film from said support surface; rotating means for rotating said roll in said cassette to present a portion of said roll to said peeling means and film cutting means formed adjacent said peeling means for cutting a portion of said film to a predetermined size.

2. The dispenser of claim 1 further including manually operable means connected to said rotating means and to said film cutting means for rotating said rotating means and for actuating said cutting means.

3. A dispenser for medicinal film stored on a roll, said roll having a support surface for said medicinal film; a cassette having a first compartment for storing said roll and a second compartment for storing said support surface, means in said cassette for separating said support surface and said film, manually actuated roller means mounted adjacent said cassette for advancing a portion of said roll for separation by said separating means and, after separation, advancing said film to a cutting location and said support surface to said second compartment and film cutting means formed at said cutting location, said film cutting means being attached to and activated by said manually actuating means for cutting a portion of said film to a predetermined size.

4. The dispenser of claim 3 further including mounting means for pivotally mounting said cassette for engagement and disengagement with said roller means.

5. The dispenser of claim 4 wherein said cassette is removably mounted on said mounting means.

6. The dispenser of claim 5 further including a latch for holding said cassette in engagement with said roller means.

7. A dispenser for rolled film material removably affixed to a supporting layer comprising: a support; a removable cassette pivotally mounted on said support for movement into and out of a working position; roller means, mounted on said support, for engaging a portion of said cassette when said cassette is in said working position, latch means pivotally mounted on said support, for holding said cassette in said working position and permitting said cassette to pivot out of said working position, peeling means formed in said cassette to peelably remove said film from said supporting layer, manually actuated lever means attached said roller means, for actuating said roller means thereby causing said roll film material to move a portion of said roll film material to said peeling means, a cutting blade mounted on said support, said cutting blade being connected to said manually actuated lever means for cutting a portion of said film material to a predetermined size after said portion of roll film material passes through said peeling means.

* * * * *